US006095753A

United States Patent [19]

Hsu

[11] Patent Number: 6,095,753

[45] Date of Patent: Aug. 1, 2000

[54] STRUCTURE FOR MOUNTING BLADES OF A CEILING FAN

[76] Inventor: Kuang-Hsiung Hsu, P.O. Box 82-144, Taipei, Taiwan

[21] Appl. No.: 09/186,617

[22] Filed: Nov. 6, 1998

[51] Int. Cl.[7] ..... B63H 1/20

[52] U.S. Cl. ..... 416/210 R; 416/204 R; 416/207; 416/208; 416/214 R; 416/244 R

[58] Field of Search ..... 416/204 R, 207, 416/208, 210 R, 214 R, 244 R, 5

[56] References Cited

U.S. PATENT DOCUMENTS

| | | | |
|---|---|---|---|
| 5,458,463 | 10/1995 | Chiang | 416/210 R |
| 5,927,945 | 7/1999 | Chen | 416/5 |
| 5,951,197 | 9/1999 | Wu | 403/315 |

*Primary Examiner*—Edward K. Look
*Assistant Examiner*—Ninh Nguyen
*Attorney, Agent, or Firm*—A & J

[57] ABSTRACT

An improvement in the structure for mounting blades of a ceiling fan, characterized in that a motor comprises a bottom formed with a plurality of brackets each having a recess, the recess having an inner end which gradually decreases in size toward an outer end thereof, each of the blade having an inner end provided with a fixing member which extends outwardly and upwardly to form a tongue having an outer end which gradually increases in size toward an inner end of the tongue, the tongue being configured so that the outer end of the tongue has same size as the outer end of the recess while the inner end of the tongue has same size as the inner end of the recess thereby enabling the tongue 211 to fit into the recess from the inner end of the recess but not slide out of the outer end of the recess.

3 Claims, 6 Drawing Sheets

STRUCTURE FOR MOUNTING BLADES OF A CEILING FAN

BACKGROUND OF THE INVENTION

1. Field of the Invention

This invention is related to an improvement in the structure for mounting blades of a ceiling fan.

2. Description of the Prior Art

Referring to FIG. 1, the blade 15 is provided at an inner end with a fixing member 11 having a T-shaped shoe 12 which is secured to the bottom of a motor 14 by screws 13 thereby causing much inconvenience in assembly. Furthermore, the blade 15 will be very difficult to be dismantled from the motor 14 once fastened on the motor 14 thus making it very inconvenient to clean the blade 15.

Therefore, it is an object of the present invention to provide an improvement in the structure for mounting blades of a ceiling fan.

SUMMARY OF THE INVENTION

This invention is related to an improvement in the structure for mounting blades of a ceiling fan.

It is the primary object of the present invention to provide an improvement in the structure for mounting blades of a ceiling fan which enables the blade from dismantling from the ceiling fan without any tools as required.

It is another object of the present invention to provide an improvement in the structure for mounting blades of a ceiling fan which enables the blade from dismantling from the ceiling fan as required.

It is still another object of the present invention to provide an improvement in the structure for mounting blades of a ceiling fan which is simple in construction.

It is still another object of the present invention to provide an improvement in the structure for mounting blades of a ceiling fan which is easy to manufacture.

It is a further object of the present invention to provide an improvement in the structure for mounting blades of a ceiling fan which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
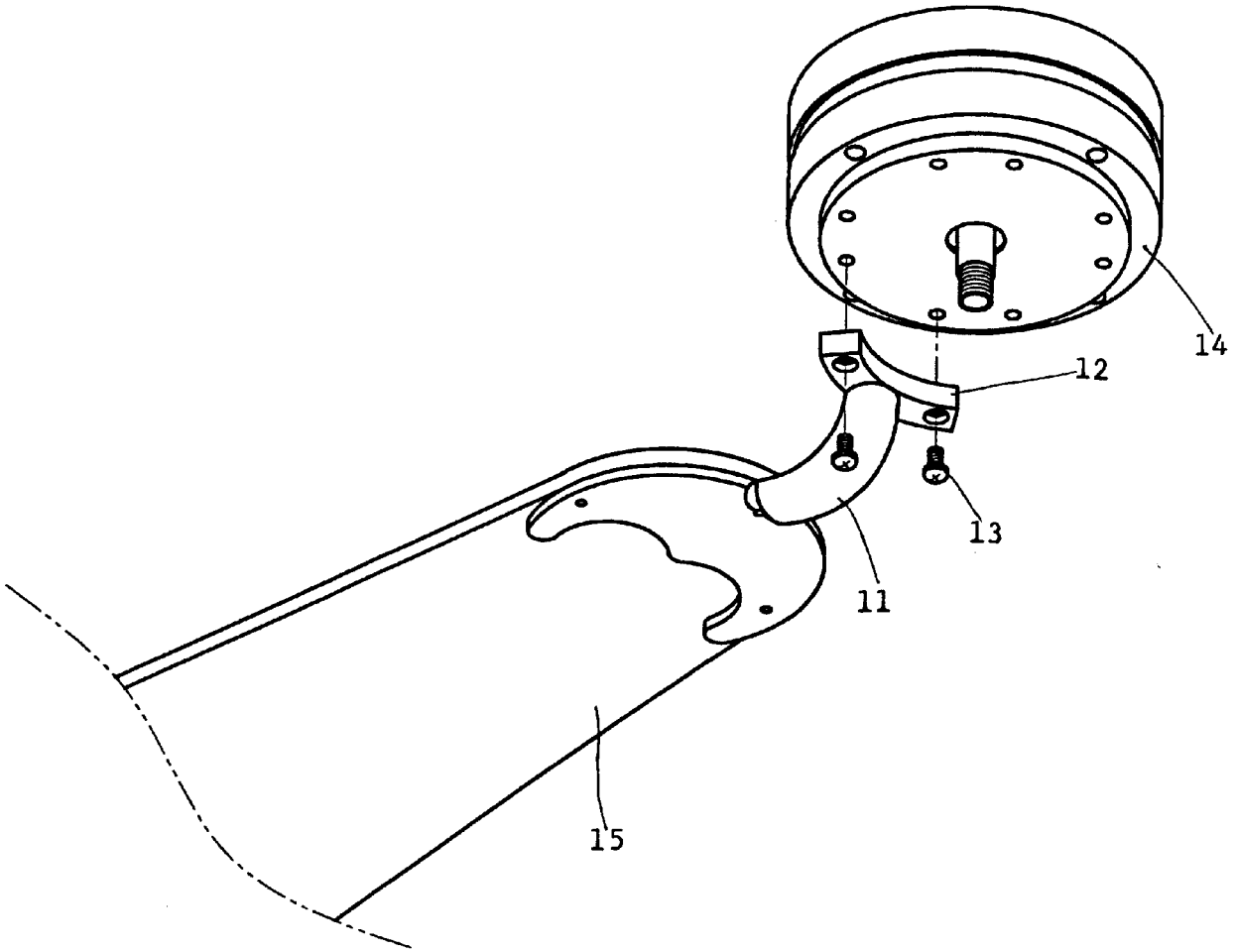
PRIOR ART FIG. 1
FIG. 1 illustrates a prior art structure for mounting a blade of a ceiling fan.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
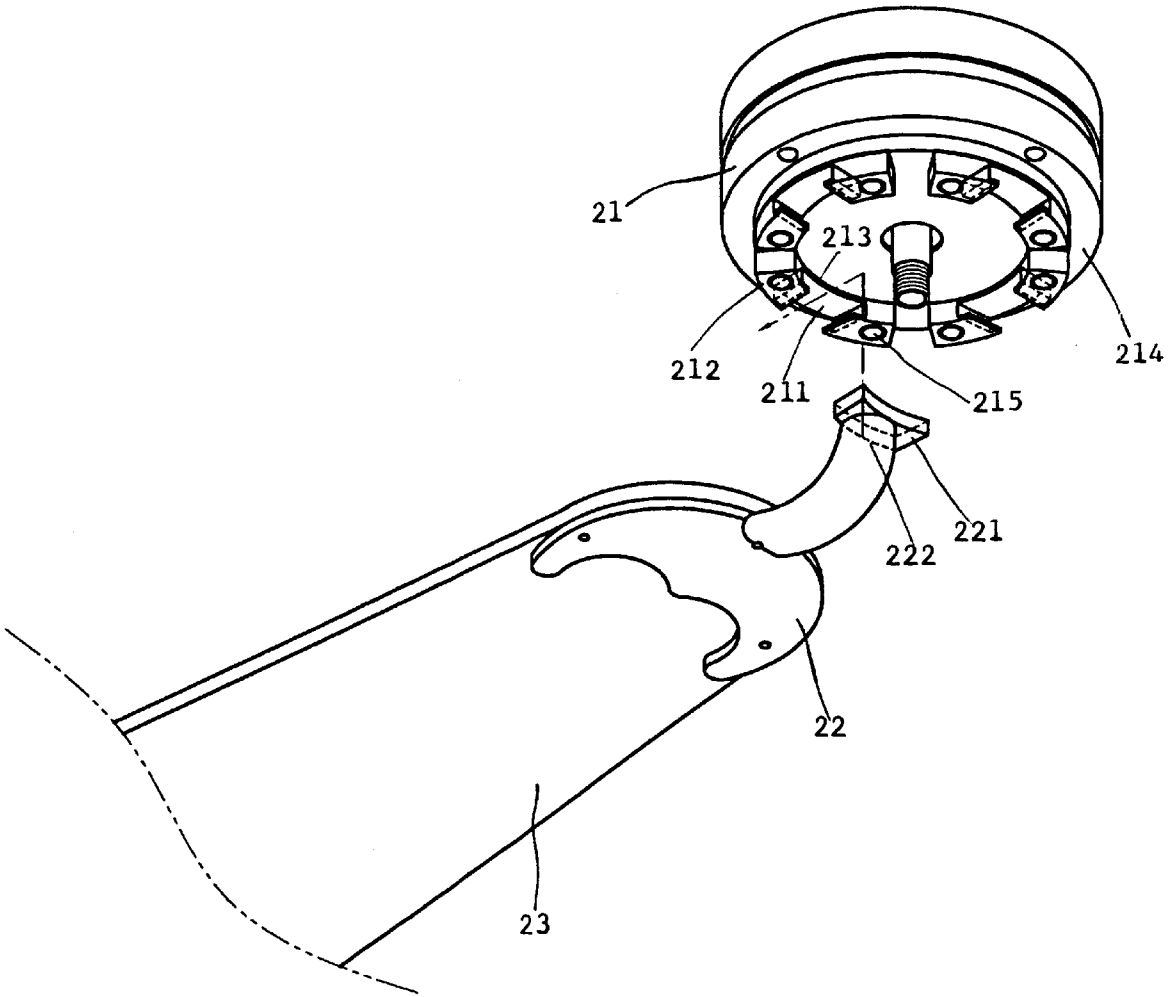
FIG. 2 is an exploded view showing the structure for mounting blades of a ceiling fan according to the present invention.
Figure 3:
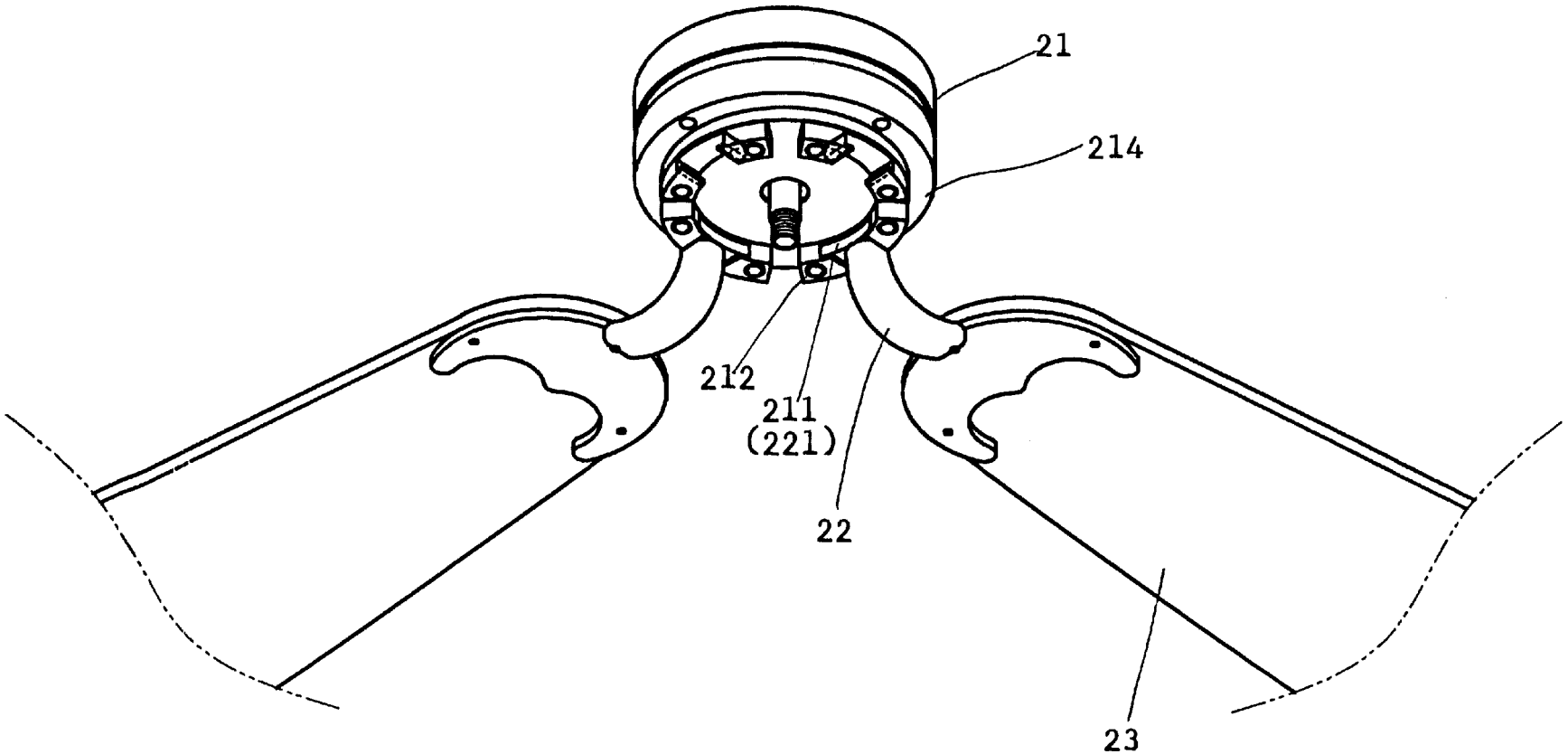
FIG. 3 is a perspective view of the present invention.
Figure 4:
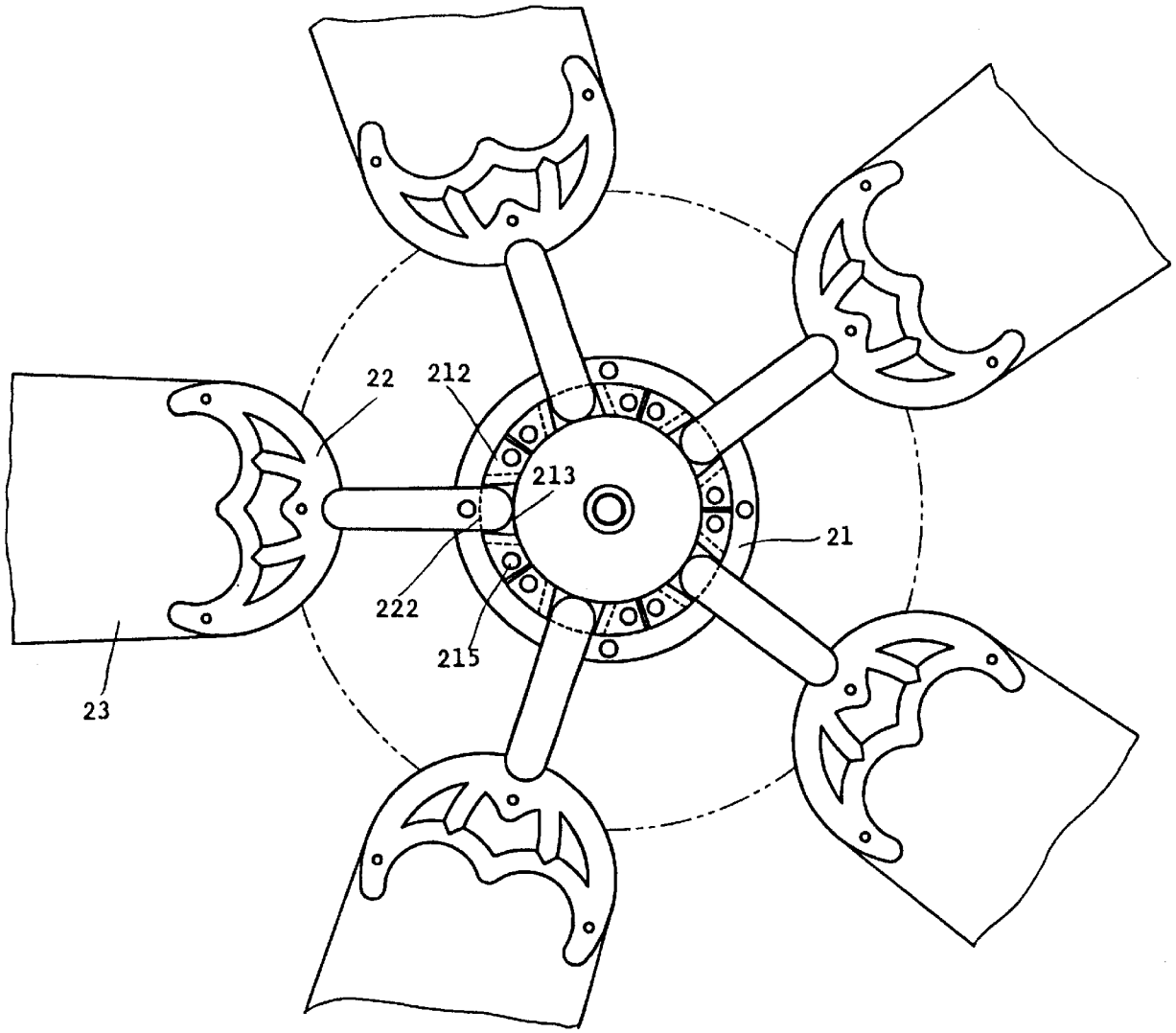
FIG. 4 illustrates a plan view of the present invention.

With reference to the drawings and in particular to FIGS. 2, 3 and 4, the present invention comprises a motor 21 having a bottom formed with a plurality of brackets 212 each having a recess 211. The brackets 212 are fastened on the bottom of the motor 21 by screws 215. The recess 211 has an inner end 213 which gradually decreases in size toward the outer end thereof.

The blade 23 is provided at the inner end with a fixing member 22 which extends outwardly and upwardly to form a tongue 221 having an outer end 222 which gradually increases in size toward the inner end thereof. The tongue 221 is configured so that the outer end 222 of the tongue 211 has the same size as the outer end of the recess 211 while the inner end of the tongue 221 has the same size as the inner end 213 of the recess 211. Hence, the tongue 211 can fit into the recess 211 from the inner end 213 of the recess 211 but not slide out of the outer end of the recess 213.

When in assembly, the tongue 211 of the blade 23 is simply slid in the recess 211 of the motor 21 from the inner end 213. As the blade 23 is rotated by the motor 21, a centifugal force will be applied to the tongue 211 thereby forcing the tongue 221 to have a tendency to move outwardly with respect to the recess 211 and therefore further strengthening the engagement between the blade 23 and the motor 21.

Figure 5:
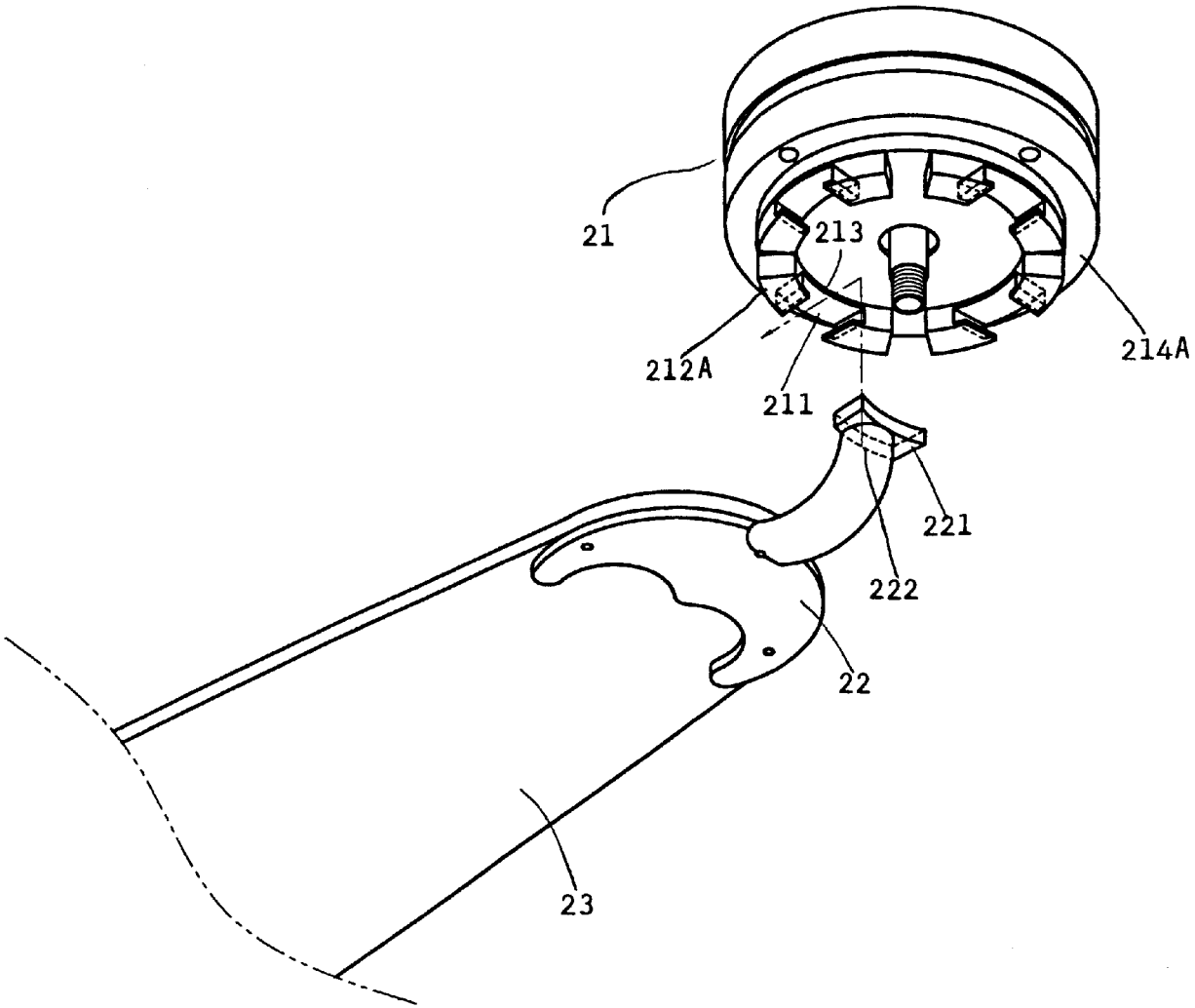
FIG. 5 illustrates a second preferred embodiment of the present invention.
Figure 6:
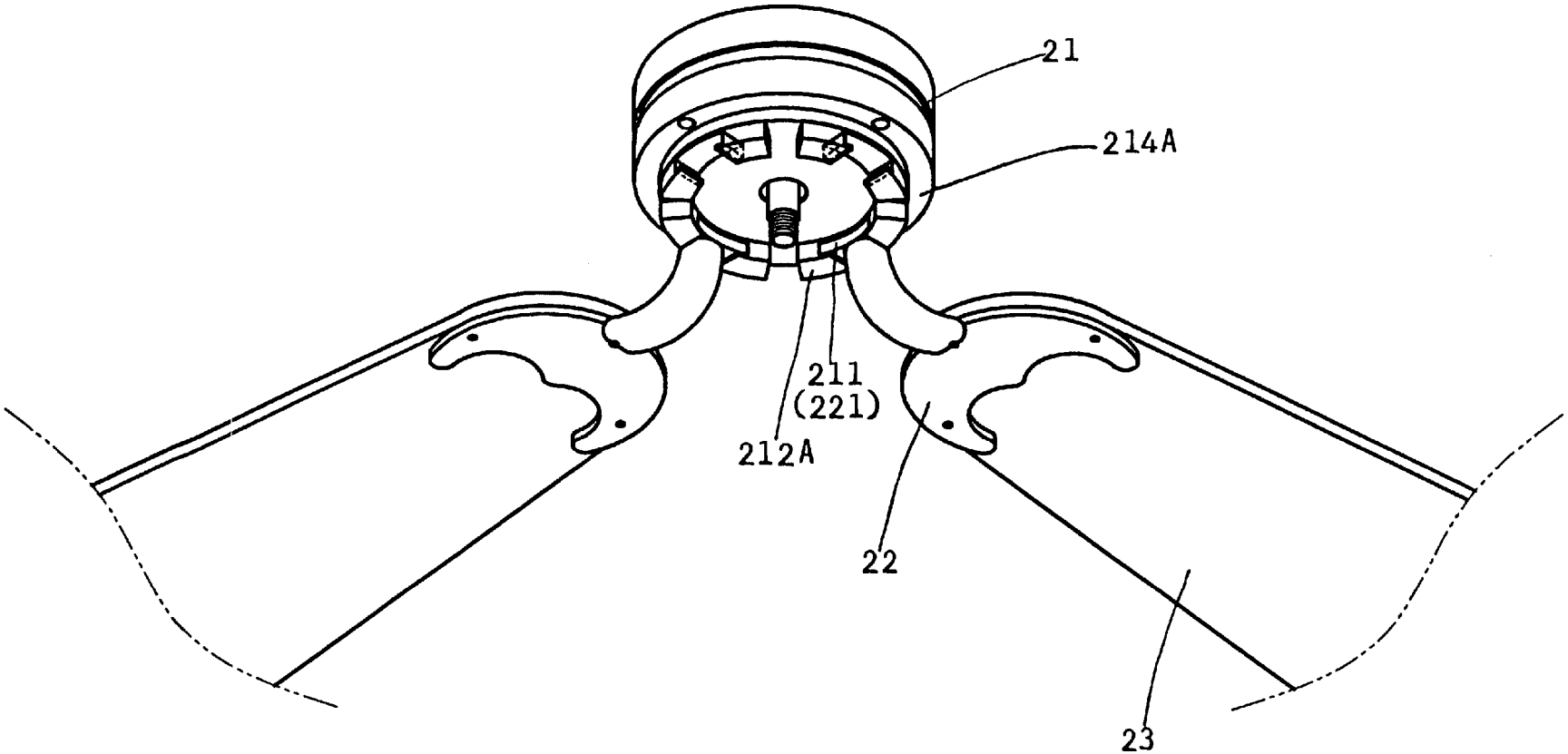
FIG. 6 is a perspective view of the second preferred embodiment of the present invention.

FIGS. 5 and 6 illustrate a second preferred embodiment of the present invention. As shown, the brackets 212A are formed integrally with the housing 214A of the motor 21 so that it is unnecessary to fasten the brackets on the motor by screws.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. In a ceiling fan provided with a plurality of blades and a motor, said motor comprising a bottom formed with a plurality of brackets each having a recess, said recess having an inner end which gradually decreases in size toward an outer end thereof, each of said blade having an inner end provided with a fixing member which extends outwardly and upwardly to form a tongue having an outer end which gradually increases in size toward an inner end of said tongue, said tongue being configured so that said outer end of said tongue has same size as said outer end of said recess while said inner end of said tongue has same size as said inner end of said recess thereby enabling said tongue to fit into said recess from said inner end of said recess but not slide out of said outer end of said recess.

2. The ceiling fan as claimed in claim 1, wherein said brackets are fastened on said bottom of said motor by screws.

3. The ceiling fan as claimed in claim 1, wherein said brackets are integral with said bottom of said motor.

* * * * *